US005265585A

United States Patent [19]

Stinson

[11] Patent Number: 5,265,585

[45] Date of Patent: Nov. 30, 1993

[54] DOUBLE-LOCKING MOUNT FOR ARROW QUIVER

[76] Inventor: Robert E. Stinson, 7292 Peaceful Valley Rd., Acme, Mich. 49610

[21] Appl. No.: 819,121

[22] Filed: Jan. 10, 1992

[51] Int. Cl.[5] ..... F41B 5/00

[52] U.S. Cl. ..... 124/88; 124/44.5

[58] Field of Search ..... 124/25.5, 25.7, 41.1, 124/86, 88, 44.5

[56] References Cited

U.S. PATENT DOCUMENTS

| | | | |
|---|---|---|---|
| 3,777,734 | 12/1973 | Rose | 124/88 X |
| 4,156,496 | 5/1979 | Stinson | 124/23 |
| 4,363,312 | 12/1982 | Spitzke | 124/88 X |
| 4,621,606 | 11/1986 | Toth | 124/24.1 |
| 4,635,350 | 10/1987 | Shepley et al. | 124/25.5 X |
| 4,635,611 | 1/1987 | Priebe | 124/88 X |
| 4,704,800 | 11/1987 | Stinson | 33/265 |
| 4,788,961 | 12/1988 | Toth | 124/88 X |

*Primary Examiner*—Randolph A. Reese
*Assistant Examiner*—Anthony Knight
*Attorney, Agent, or Firm*—Price, Heneveld, Cooper, DeWitt & Litton

[57] ABSTRACT

A double-locking mount is disclosed for attaching an arrow quiver onto a bow. The arrow quiver has an elongated frame member for supporting an arrowhead protecting shield and an arrow shaft holder. A quiver mount, including a tapered mounting plate, is defined on the quiver frame. A mounting bracket which is mountable on a bow has a longitudinal tapered channel which is closed at one end, for receiving the tapered mounting plate on the quiver mount. The mounting bracket is oriented on the bow with the closed end of the channel at the bottom, so the quiver mounting plate cannot slide through the mounting bracket. A movable locking member is attached to the mounting bracket and has a finger latch which extends over and reversibly blocks the channel in the mounting bracket. The finger latch has a projecting portion which applies pressure to the quiver mount to hold it tightly in place in the mounting bracket. An elongated threaded locking member with a finger knob is threaded through a transverse aperture in the quiver mount and is engageable with a lock-receiving depression on the mounting bracket. When so engaged, the threaded locking member reversibly locks the quiver to the mounting bracket, protecting the user of the bow and the arrows in the quiver from injury should the movable locking member be accidentally opened. The threaded locking member also prevents noise generation caused by movement of the quiver mounting plate inside the mounting bracket.

14 Claims, 1 Drawing Sheet

DOUBLE-LOCKING MOUNT FOR ARROW QUIVER

BACKGROUND OF THE INVENTION

When a bow hunter is hunting game such as deer, it is common practice for the hunter to work his way into a thicket or into heavy brush where the hunter is concealed from observation by the deer. While approaching the preferred hunting spot and while in position, the hunter's bow is frequently buffeted or brushed by branches and the like.

A hunter using a compound bow typically attaches directly to the bow a quiver containing a supply of sharpened hunting arrows. The arrows are frequently of the broadhead type having multiple razor-sharp blades about the tip of the arrow. The arrowheads are normally protected from contacting each other in the quiver and are also enclosed within a safety cover ("broadhead shield") to protect the hunter from accidental contact. The shaft of each arrow is usually held in a resilient clamping means so that the hunter can easily detach an arrow and bring it into position for shooting by the bow.

A very successful means for mounting the hunting quiver onto the compound bow is that disclosed in U.S. Pat. No. 4,156,496 issued May 29, 1979 to Robert E. Stinson, which employs a resilient latch member positioned on one side of a mounting bracket. This prior patent, which is by the same inventor as the present invention and is incorporated herein by reference, also shows a mounting bracket which has a channel for receiving a mounting plate on the frame of the quiver in a tongue-and-groove fashion to hold the quiver in place on the bow. As mentioned above, as the hunter works his way through the underbrush or thicket to his preferred hunting spot, the quiver is frequently brushed or buffeted by brush, saplings, etc., and this can at times cause the resilient latch on the side of the quiver mount to be accidentally released, allowing the quiver to fall from the bow and possibly being lost or damaged, or dislodging one or more arrows and placing the hunter at risk of injury. Also, in view of the delicate nature of the razor-sharp edges on the hunting arrows, these edges can easily be chipped or broken if struck together.

Through extensive use of the hunting quiver on the compound bow, and the frequent attachment and detachment of the quiver from the bow, it is possible for dirt or snow, etc. to lodge between the interconnecting components, or for the latter to be damaged or misshapen, thereby causing faulty or potentially faulty mounting of the quiver. Also, by the very nature of the plastic materials used and the molding processes used to form the quiver mount and mounting bracket, it is possible for a slight amount of clearance to be present between these two components in certain cases. The slight difference in size and resulting space between the components can result in the generation of noise which can be detected by the hunted game. Since the usual bow hunter relies on stealth and camouflage to position himself in close proximity to the hunted game, noise is objectionable and cannot be tolerated. It is important then for the hunter to have a quiver mount which cannot become accidentally detached from the bow, and also a quiver mount which does not generate noise detectable by the hunted game.

SUMMARY OF THE INVENTION

In accordance with the present invention a novel double-locking mount is provided for attaching the arrow quiver to the bow. This locking mount employs a resilient latch, which may be used alone in practice and in upland hunting or while transporting the quiver in the open, where there is no danger of the quiver being dislodged from the bow. At the same time, a secondary lock is provided which is called into play when the hunter is preparing to stalk a game animal or for other reasons pass into or through brush which might accidentally detach the arrow quiver from the bow if the hunter were only to rely on the spring latch. The second latch cooperates closely with the first, and serves to positively secure the quiver to the mounting bracket so that it cannot accidentally be released to fall from the bow. The second lock operates in a cooperative and synergistic manner with the first by applying pressure to the mounting bracket, which prevents any motion between the mounting plate on the quiver and the mounting bracket on the bow, thereby eliminating or substantially reducing any noise which might be generated by actions affecting the quiver mount. The hunter is then safely prepared to quietly enter the brush, without concern over such undesired effects.

DETAILED DESCRIPTION OF THE PREFERRED EMBODIMENT

Figure 1:
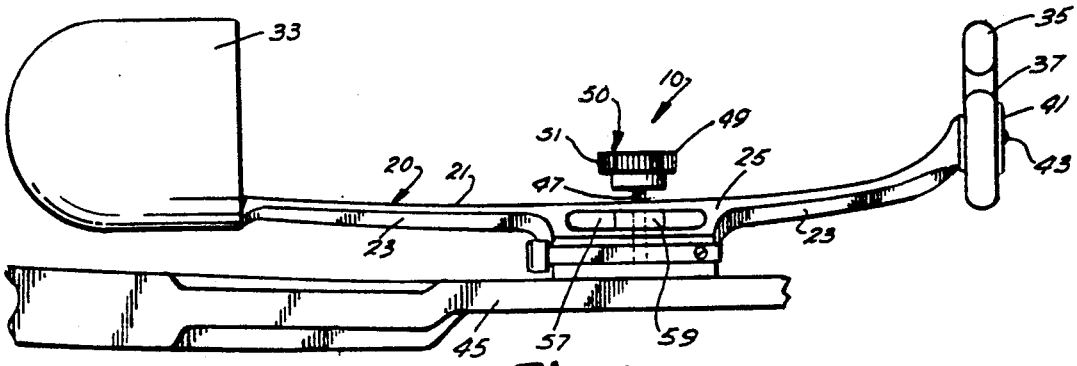
FIG. 1 is a fragmentary side elevational view showing a quiver attached to a bow by a double-locking quiver mount in accordance with the invention.
Figure 2:
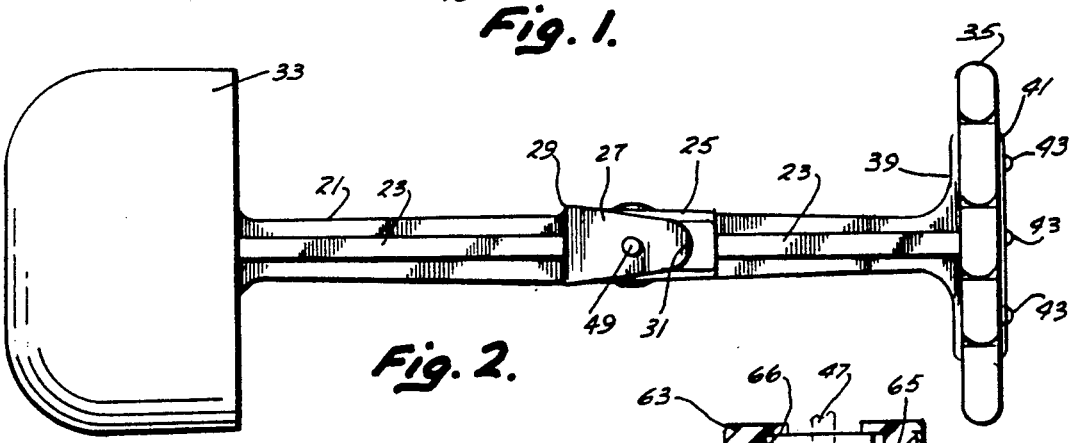
FIG. 2 is a bottom plan view of the quiver shown in FIG. 1, depicting the mounting plate.

Referring to FIGS. 1 and 2, a double-locking quiver mount is indicated generally by the number 10. A quiver 20 has an elongated frame 21 which is preferably made of a plastic material. The frame has a longitudinal reinforcing rib 23 extending inwardly from each end of the frame to a medial location where the rib is enlarged to define a mount 25. A mounting plate or mounting flange 27 is formed on the bottom of the quiver mount. Flange 27 has a projecting edge 29 which tapers to an arcuate end portion 31, substantially in line with the longitudinal axis of frame 21.

Quiver 20 has an oblong, dome-shaped shield 33 mounted at one end and an arrow shaft-supporting member 35 disposed at the other end. Since most hunting arrows today are the broadhead type, which have two or more razor-sharp edges, it is important to protect the hunter from accidental contact with the arrowheads. Thus, the heads of a plurality of hunting arrows can be placed within shield 33 in suitable segregated areas, while the shafts of the arrows extend toward the right, as shown in FIG. 1, and are supported within a resilient support having shaped apertures 37 for holding each arrow shaft. Arrow shaft support 35 is preferably made of a rubber-like plastic material which can grip the shafts of the arrows to hold the arrows in place while, at the same time, freely releasing the arrows when the same are pulled by the hunter. The shaft support is fastened to an elongated flange 39 formed at the end of quiver frame 21 by a plate 41 and a plurality of suitable fasteners 43.

Figure 5:
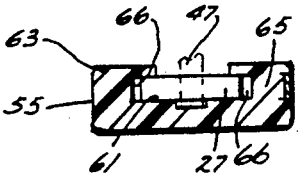
FIG. 5 is a sectional view of the mounting bracket and mounting plate taken along the plane V-V of FIG. 4.
Figure 3:
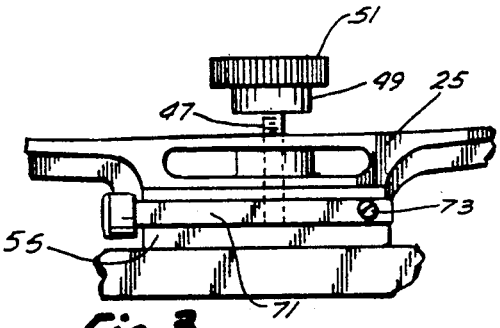
FIG. 3 is an enlarged, fragmentary view of the double-locking quiver mount.
Figure 4:
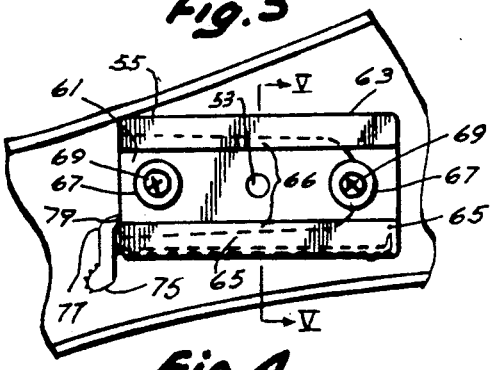
FIG. 4 is a fragmentary, plan view of a quiver mounting bracket in accordance herewith fastened to a bow.
Figure 6:
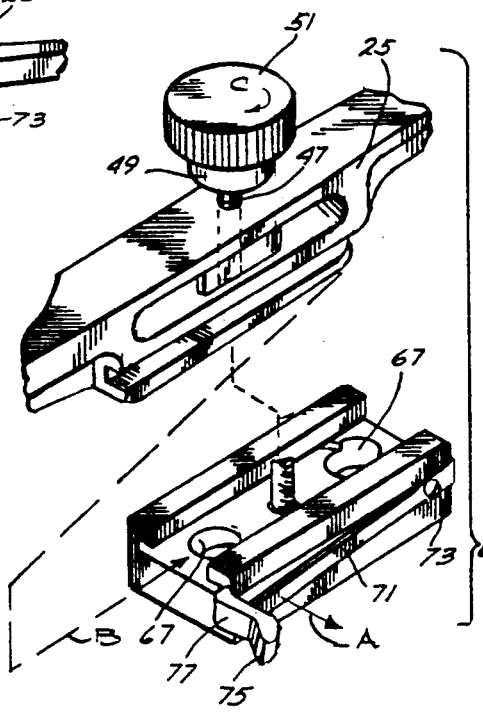
FIG. 6 is an exploded view of the double-locking quiver mount.

Arrow quiver 20 is attached to the side of bow 45 by two mutually cooperating locking devices. The first such device includes a threaded bolt-like member 47 which is threadably received in an aperture 49 which extends through quiver mount 25. Threaded member 47 has a finger knob 49 attached to the top. Knob 49 has a serrated edge 51 to facilitate turning the knob by hand. Threaded member 47 can be turned by knob 49 so that it extends through mounting flange or mounting plate 27 into a depression 53 substantially centrally disposed in the bottom of a mounting bracket 55 (FIGS. 4, 5 and 6). Quiver mount 25 has a depression 57 (FIG. 1) formed in each side of frame 21 which provides a convenient finger grip for holding quiver 20. Substantially centrally positioned in recess 57 on each opposite side of the quiver frame is a rib-like portion forming a boss 59 through which the threaded aperture 49 extends. The material forming protrusion 59 reinforces frame 21 in the vicinity of the threaded aperture 49.

Referring to FIGS. 4, 5 and 6, the substantially rectangular mounting bracket 55 has a bottom surface 61 bounded on the top and bottom, as shown in FIGS. 4 and 5, by a pair of upstanding walls 63 and 65. A shaped longitudinal groove 66 is formed in each of the sides for receiving the shaped mounting flange 27 on the bottom of quiver mount 25. A pair of spaced apertures 67 is provided in bottom surface 61 for receiving suitable fasteners such as flat-headed machine screws 69 for attaching the mounting bracket 55 to bow 45.

A strip of stiffly resilient material 71 (such as a spring steel leaf) extends along one side of bracket 55 and is attached to the side thereof by a suitable fastener 73 to serve as a thumb or finger latch. An actuation member 75 is attached to the end of member 71. The strip member 71 provides a resiliently-biased latch which normally blocks groove 66 in side 65 of mounting bracket 55. The top surface of the latch tip 75 has a camming surface 77 which enables the arcuate leading edge of mounting flange 27 to push the finger latch aside as the quiver is slid into the grooved longitudinal channel in mounting bracket 55. When the mounting flange is fully in position in mounting bracket 55, latch tip 75 will snap over the edge of the mounting flange, with projecting portion 79 resiliently pressing against the mounting flange, locking the quiver to the mounting bracket and taking up any incidental clearance which might allow relative movement and corresponding noise. As will be understood, the latch means just described could also be implemented by other forms of generally analogous spring-biased members, including elongated strips which are not themselves flexible but are flexibly mounted to achieve the same basic result.

Mounting bracket 55 is preferably used in practice and in most hunting situations. Since the quiver is only held to the bow by a resilient latch, it is possible for the latch to be accidentally opened by a branch, a pack strap, a tent rope or a fence wire in climbing a fence. If the resilient latch is released, the quiver can fall to the ground exposing the hunter to the sharpened arrows, and the edges of the arrows can be damaged in striking against each other. In order to prevent any accidental loss of the quiver in moving the combined bow and quiver, threaded lock 50 positively locks the quiver to the mounting bracket when threaded member 47 is threaded completely through quiver mount 25 and extends into recess 53 in the bottom of mounting bracket 55.

Lock 50 can be turned by knob 49 so that a positive pressure is applied between the mounting bracket 55 and quiver mount 25, tending to push the two laterally apart. The thickened portion of quiver frame 59 resists this force and causes the projecting edges 29, 31 of quiver mount 25 to push against sides 63 and 65 of mounting bracket 55, thereby firmly securing the quiver frame and mounting bracket together, precluding any relative movement and corresponding noise generation. Depression 53 is deep enough so that even if lock 50 is loosened a small extent, the end of threaded member 47 will not exit depression 53 sufficiently to enable mounting plate 27 to slide longitudinally of mounting bracket 55. Thus, the arrow quiver is positively protected against accidental dislodgement from the bow even if the resiliently-biased latch 71, 75 is inadvertently opened. In this regard, it will be understood that the two locking mechanisms are mutually cooperative and complementary in nature and function, since each works toward the same end and each is likely to be effective even if the other is disabled or otherwise improperly operated The hunter can therefore safely transport the combined bow and arrow quiver without fear of dislodging the quiver and possibly losing or damaging it, or of injury or damage to either the hunter or the arrowheads.

Though the invention has been described with respect to a specific preferred embodiment thereof, many variations and modifications will become apparent to those skilled in the art after considering this preferred embodiment. It is therefore the intention that the appended claims be interpreted as broadly as possible in view of the prior art to include all such variations and modifications, whether directly and literally or by application of the doctrine of equivalents.

The embodiments of the invention in which an exclusive property or privilege is claimed are defined as follows:

1. A double-locking mount for a bow-mounted quiver, comprising:

an elongated frame member for said quiver;

a quiver mount defined by said frame member at a point inwardly of its end extremities, said quiver mount having a transverse aperture therein and a mounting plate element with projecting edge portions;

a first locking means for said quiver movably supported in said aperture in said quiver mount;

a mounting bracket for said quiver mount, said mounting bracket having a longitudinal channel therein defined by a bottom surface and opposed, spaced walls extending away from said bottom surface, at least one of said walls defining a longitudinal groove for receiving said projecting edge portions of said mounting plate in a tongue-and-groove relationship, said mounting bracket including means for mounting said bracket on a bow;

a receiving means for said first locking means disposed on and carried by said mounting bracket in alignment with said first locking means to receive portions of said first locking means upon movement thereof in said aperture, to thereby provide a first lock mechanism between said quiver and mounting bracket; and a second locking means for said quiver including a movable finger latch means for reversibly closing at least a portion of said longitudinal channel in said mounting bracket to prevent disengagement of said tongue-and-groove relationship, said first and second locking means being separately operable and also adapted to complement one another in holding said mounting plate edge portions in place in said tongue-and-groove relationship with said longitudinal groove in said mounting bracket to thereby maintain said quiver in double-locked position upon said bracket.

2. A double-locking mount for a bow-mounted quiver as set forth in claim 1, wherein:

said mounting plate has a projecting tapered edge portion for positioning in said at least one longitudinal groove in said mounting bracket; and said channel in said mounting bracket has a generally closed end and said at least one groove in said channel is tapered to conform to the tapered edge of said mounting plate portion.

3. A double-locking mount for a bow-mounted quiver as set forth in claim 1, wherein said first locking means is adapted to apply pressure to said mounting bracket to lock said quiver mount tightly in place and substantially preclude movement of said quiver mount in said mounting bracket to thereby substantially eliminate resulting noise.

4. A double-locking mount for a bow-mounted quiver as set forth in claim 1, wherein:

said first locking means has a threaded portion and is activated by rotating such portions into a threaded aperture of said quiver mount; and a finger knob for turning said first locking means, said finger knob being aligned with said elongated frame for said quiver and being sufficiently large to be grasped and turned manually, said knob having a silhouette which is low enough relative to the quiver frame to clear the shafts of arrows supported in the quiver.

5. A double-locking mount for a bow-mounted quiver as set forth in claim 1, wherein said mounting plate on said quiver mount is tapered and said channel in said mounting bracket is correspondingly tapered so that said mounting plate is receivable within said channel but cannot slide through it and out of said mounting bracket.

6. A double-locking mount for a bow-mounted quiver as set forth in claim 1, wherein a seat is provided in the bottom surface of the channel in said mounting bracket for receiving the end of said first locking means to lock said quiver and mounting bracket together.

7. A double-locking mount for a bow-mounted quiver as set forth in claim 1, wherein said finger latch has a projecting portion for pressing against said quiver mount even when said projecting edge portions of said mount lie wholly within said longitudinal groove and do not extend outwardly there-beyond, to compensate for clearance otherwise present and thereby reduce movement between said quiver mount and said mounting bracket and thus reduce noise generated by such movement.

8. A double-locking mount for a bow-mounted quiver as set forth in claim 1, wherein said transverse aperture in said quiver mount extends through said mounting plate.

9. A double-locking mount for a bow-mounted quiver as set forth in claim 1, wherein said mounting plate on said quiver mount is substantially flat and has projecting side edges which taper toward one another to define a narrowed end portion.

10. A double-locking mount for a bow-mounted quiver as set forth in claim 1, including means for resiliently biasing said finger latch toward a position closing said portion of said longitudinal channel.

11. An arrow quiver and mount for attaching the arrow quiver to a bow, comprising:

an elongated frame member;

an arrowhead shield disposed at one end of said frame member;

an arrow shaft support on said frame member spaced from said arrowhead shield;

a quiver mount disposed on said frame member at a point medially along its elongated length, said quiver mount having a transverse threaded aperture therein;

a locking screw threadably received in said aperture in said quiver mount;

a mounting bracket for attachment to said bow, said mounting bracket having a longitudinal channel therein including opposed grooves for receiving portions of said quiver mount on said frame member in a tongue-and-groove manner;

a resiliently-biased latch means carried on said mounting bracket for reversibly opening and blocking at least a portion of said channel in said mounting bracket; and an engagement means disposed on said mounting bracket for reversibly receiving portions of said locking screw to lock said quiver mount in place upon said mounting bracket.

12. An arrow quiver and mount as set forth in claim 11, wherein:

said quiver mount is defined by a substantially rectangular, longitudinally extending, enlarged portion of said elongated frame member, said quiver mount having oppositely disposed longitudinal finger-gripping depressions on each side with a supporting boss adjacent each such depression and on either side of said threaded aperture in said quiver mount; and a substantially flat, longitudinally extending, tapered mounting plate portion of said quiver mount, said mounting plate portion having extending edges for entry into the grooves of said channel in said mounting bracket.

13. An arrow quiver and mount as set forth in claim 12, wherein said channel in said mounting bracket is tapered to matingly receive said tapered mounting plate portion of said quiver mount.

14. An arrow quiver and mount as set forth in claim 11, wherein said locking screw extends through said quiver mount on said elongated frame and is received in said engagement means on said mounting bracket to maintain said quiver frame locked onto said mounting bracket in the event said resiliently-biased latch on said mounting bracket is accidentally opened.

* * * * *